United States Patent [19]

Gruner et al.

[11] 4,019,560

[45] Apr. 26, 1977

[54] SPRAY COOLING OF CONTINUOUSLY CAST INGOTS

[75] Inventors: Hans Gruner, Duisburg-Rahm; Gerd Diederich, Angermund; Hans Butz, Duisburg; Peter Wahls, Meerbusch; Engelbert Weins, Duisburg, all of Germany

[73] Assignee: Mannesmann Aktiengesellschaft, Dusseldorf, Germany

[22] Filed: Sept. 18, 1975

[21] Appl. No.: 614,534

[30] Foreign Application Priority Data

Sept. 16, 1974 Germany ..... 2444613

[52] U.S. Cl. ..... 164/89; 164/283 R; 164/283 S

[51] Int. Cl.[2] ..... B22D 11/12

[58] Field of Search ..... 164/89, 348, 283 R, 164/283 S, 126, 128

[56] References Cited

UNITED STATES PATENTS

| | | | |
|---|---|---|---|
| 3,515,202 | 6/1970 | Bick et al. | 164/89 |
| 3,766,968 | 10/1973 | Fortner et al. | 164/89 X |

*Primary Examiner*—Travis S. McGehee
*Attorney, Agent, or Firm*—Ralf H. Siegemund

[57] ABSTRACT

Continuously cast ingots are spray-cooled by a fanned-out flow of water which has been accellerated by pressurized air with an original nozzle direction parallel to the surface of the ingot and transversely to the direction of ingot withdrawal. The arrangement avoids cooling impediment on account of the Leiden frost phenomenon.

9 Claims, 3 Drawing Figures

SPRAY COOLING OF CONTINUOUSLY CAST INGOTS

BACKGROUND OF THE INVENTION

The present invention relates to spray cooling of slab ingots produced by continuous casting.

It is common practice to spray water onto the casting as it emerges from the bottom of an open ended mold, and spray is continued for some distance along the withdrawal path, particularly as the casting is veered from a vertical orientation when leaving the mold to a horizontal orientation for further processing. Spray-cooling in one form or another is described e.g. in German Pat. Nos. 2,053,947 and 2,208,928 and also in a Handbook by E. Hermann "Handbuch des Stranggiessens", Aluminum-Verlag Dusseldorf, pages 188,189.

It was found, however, that particularly in the mold-near zones of the ingot or casting, steam is developed extensively so that a steam layer tends to isolate the casting from the spray water to some extent, and water rarely comes into direct contact with the surface to be cooled. The production and effect of that steam layer is also known as the Leiden frost phenomenon.

DESCRIPTION OF THE INVENTION

It is an object of the present invention to provide for cooling of an ingot as it emerges from a mold for continuous casting and in a manner that drastically diminishes the effect of the Leiden frost phenomenon.

It is a specific object of the present invention to spray cool a casting without incurring stagnating water between a withdrawal roll and the surface of the casting-ingot and elsewhere but in a manner which causes direct or rather even distribution of the cooling water on the ingot.

In accordance with the preferred embodiment of the invention, it is suggested to provide a cooling liquid for spray cooling of at least a total amount of 0.1 liters per kilogram steel to be cooled and to add a propellant gas at a minimum pressure of 2 bars, whereby both media are accellerated over a path of particular length prior to being emitted in fan-like jets originating between respective two rolls and, preferably, at a distance from the ingot closer than the roll axes. The gas preferably accelerates the coolant for a distance of at least 100 mm before being ejected by the nozzle.

The nozzle ends are bent off to extend parallel to the surface of the ingot, and the nozzles have oblique configuration to fan out the coolant rather widely. One will need plural nozzles, being differently oriented, but the bent off ends should extend transversely to the direction of casting. This way, one will obtain uniform coverage of the entire area between the lines of engagement of the ingot by two vertically spaced rolls. The amount of water stated above is used for the cooling region defined on the upper side of the ingot which in turn is defined by respective two vertically spaced lines of engagement with withdrawal rolls. The nozzeles are, however, provided on both sides of the ingot, so that it is possible to spray cooling medium onto both sides.

It was found that the fanned-out flow of air-accelerated water penetrates any steam layer that tends to form on the ingot surface, so that the Leidenfrost phenomenon is overcome.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Proceeding now to the detailed description of the drawing, FIG. 1 shows a pair of rolls 6, 6*a* and is, for example, a vertical elevation in a horizontal plane with section taken through a slab ingot 7. The rolls are journalled in the usual manner, and the axes of the rolls have a particular distance from the ingot. The axes can be deemed to run through planes parallel to the surface of the ingot as can be seen also from FIG. 3. Each of the rolls is undivided and extends for more than the width of the slab ingot 7.

Figure 1:
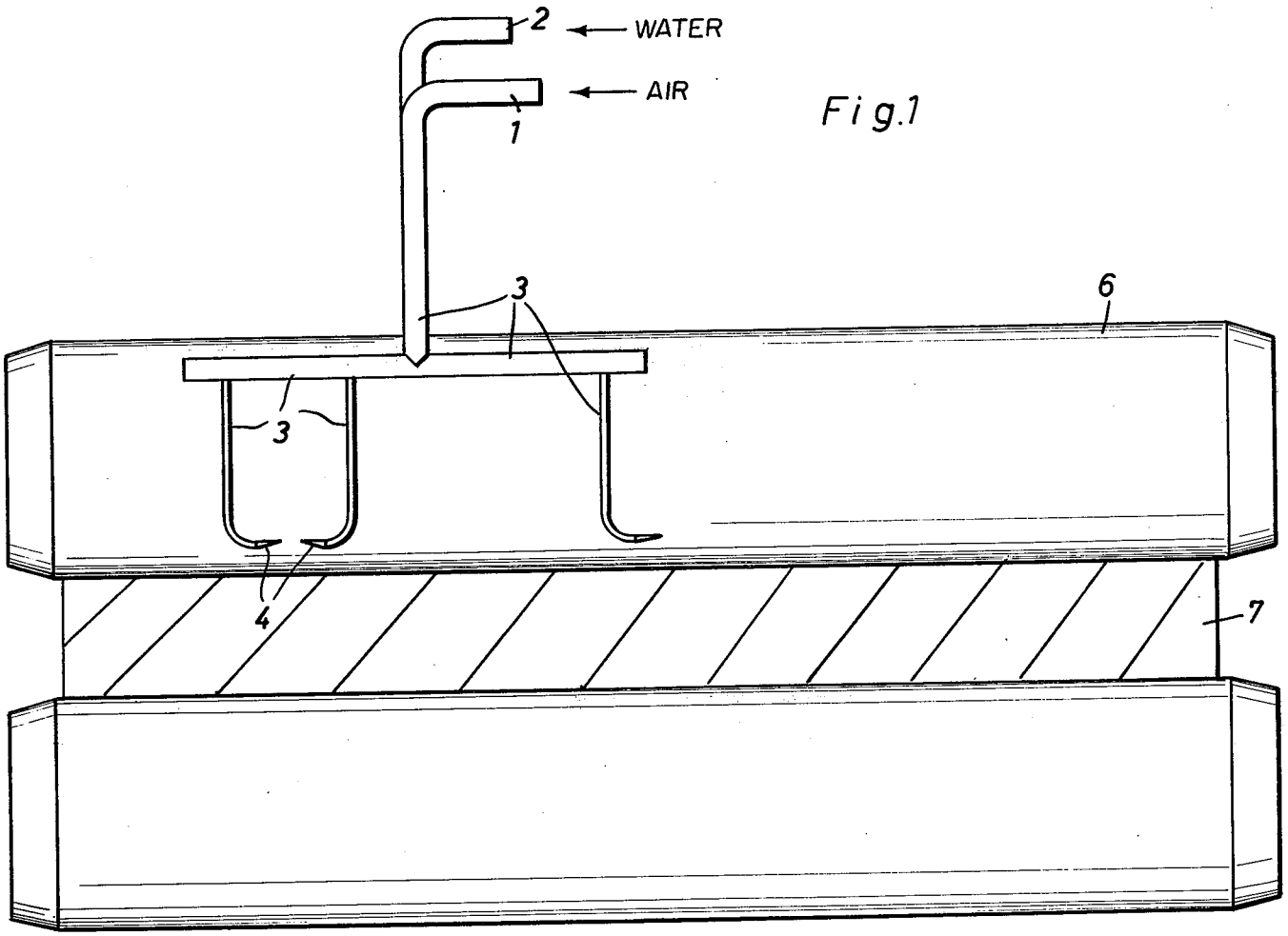
FIG. 1 is a section view taken e.g. in a horizontal plane through an ingot in the withdrawal path and showing somewhat schematically a portion of the spray equipment in accordance with the preferred embodiment.

The figures show representatively spray nozzles 4; only three are shown in FIG. 1, more are provided on the same side, and a similar arrangement is provided on the other side of ingot 7, but on the same side of the horizontal plane as defined, for example, by the two rolls as depicted in FIG. 1. The nozzles 4 (particularly the tips of the smooth wall tubes that define these nozzles) are located closer to the ingot 7 than each of the axes of the withdrawal rolls as treated with reference to the same ingot surface. Moreover, the nozzle tips of a particular group considered are located e.g. underneath a plane as defined e.g. by a pair of oppositely positioned rolls above them.

Figure 2:
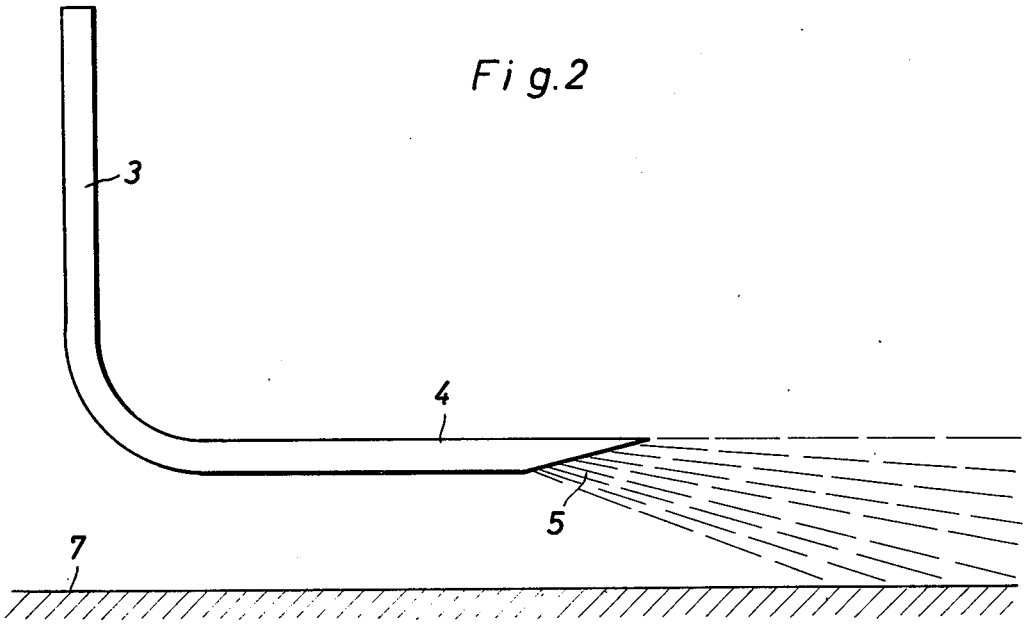
FIG. 2 is an enlargement of a salient detail.

Reference numeral 2 denotes the feeder input for cooling liquid such as water. That water is mixed with an injected gas, e.g. air under pressure of at least two bars. The water as fed is accelerated by the pressurized air as mixed therewith and in an acceleration path 3 serving also as distributor for the coolant. That path is at least 100 mm long, preferably about 400 mm. The distributor outlets are provided by the nozzle elements 4 having a construction shown in greater detail in FIG. 2.

Figure 3:
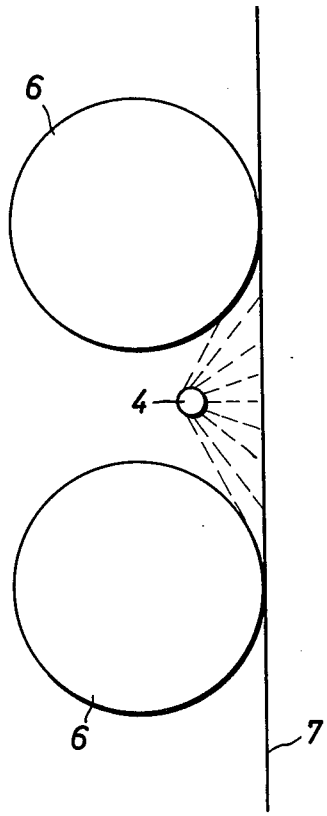
FIG. 3 is a portion of a schematic longitudinal section view in a plane that includes the direction of the withdrawal path.

Each of the nozzles 4 is a tube with an end portion extending parallel to the surface of ingot 7 and terminating in an obliquely cut end, forming a rather acute angle to the axis of the tube. That axis of each nozzle, of course, extends parallel to the surface of the ingot and in a direction transverse to the direction of casting. That latter direction runs at right angles to the planes of FIGS. 1 and 2. The nozzle tubes may have circular, elliptical, rectangular or trapezoidal cross-section. Therefore, the water-air mixture as ejected by the nozzle fans out rather broadly. The fan-out occurs in a horizontal plane as can be seen from FIG. 2 and also in a vertical plane as illustrated in FIG. 3. The latter fanning is particularly important if one considers that the nozzle is closer to the ingot than the axes of the two vertically arranged rolls. This way one obtains a rather uniform covering of the surface portion of the ingot as extending between the two lines of engagement with the two rolls of FIG. 3.

The total amount of spray water ejected against the ingot in such a space between two rolls on one side of the ingot is about 0.1 to 2.2 liters water per kilogram cast steel. The preferred range is from 0.15 to 0.3 liters water per kilogram steel. The amount of water thus sprayed is controlled by the amount of air as injected into the flow of water is fed to nozzle 4.

The entire cooling zone as it extends from the bottom of the mold is usually divided into several zones of different lengths. Assuming a slab ingot of 2000 by 200 mm of high tensile strength steel is cast, being identified by × 60 in accordance with API. Such a steel is used for making large pipes. If one uses an air pressure of 4 bar as propellant and for a normal casting speed, one will apply the following quantities of water:

Zone 1 — 65 liter per minute
zone 2 — 65 liter per minute
zone 3 — 35 liter per minute
zone 4 — 45 liter per minute These are the four curved zones. The hozizontal zone (5) thereafter is cooled at a rate of 90 l/min.

The invention is not limited to the embodiments described above, but all changes and modifications thereof not consituting departures from the spirit and scope of the invention are intended to be included.

We claim:

1. Apparatus for spray cooling a continuously cast ingot as withdrawn from the mold by plural rolls arranged along the ingot and having horizontal axes, the rolls each extending for at least the width of the ingot in undivided configuration, comprising:

a plurality of nozzles arranged between respective two vertically spaced rolls and one each side of the ingot;

means for mixing a coolant with a pressurized propellant and for accelerating the coolant by the propellant prior to feeding the coolant to said nozzles; and the nozzles disposed and constructed to cause wide fan - out flow against the surface of the ingot, beginning along an axis extending parallel to the surface.

2. Apparatus as in claim 1, said nozzles disposed so that the origin of each fan has a distance to the ingot closer than the distance between the ingot and the axes of the said spaced rolls.

3. Apparatus as in claim 1, wherein said means for accelerating has an acceleration path of at least 100 mm length.

4. Apparatus as in claim 1, wherein each of the nozzles is a smooth wall tube with obliquely cut ends.

5. Apparatus as in claim 4, wherein each nozzle tube has elliptical, rectangular, or trapezoidal cross-section.

6. Apparatus as in claim 1, wherein the plural nozzles are laterally offset and oriented to spray in different directions.

7. Method of spray cooling continuously cast ingots as emerging and withdrawing from a mold by means of rolls comprising the steps of providing a flow of cooling liquid to obtain a quantity of at least 0.1 liters per kilogram ingot steel to be cooled;

adding a gaseous propellant to the liquid at a pressure of at least two bars and causing the gaseous propellant to accelerate the liquid; and causing the accelerated liquid with gaseous propellant to be sprayed in a direction parallel to the ingot surface and in a broadly fanned-out flow, originating between respective two withdrawal rolls.

8. Method as in claim 7 and causing the fan in each instance to oiginate at a distance from the ingot closer than the distance of the axes from the ingot.

9. Method as in claim 7, wherein said acceleration is caused for a length of at least 100 mm.

* * * * *